United States Patent [19]

Turley et al.

[11] Patent Number: 4,752,040

[45] Date of Patent: Jun. 21, 1988

[54] JAW CRUSHER WITH DROP-IN JAWS

[75] Inventors: Laurence U. Turley, 2665 E. Desert La., Gilbert, Ariz. 85234; David P. McConnell, Jr., Mesa, Ariz.

[73] Assignee: Laurence U. Turley, Gilbert, Ariz.

[21] Appl. No.: 943,548

[22] Filed: Dec. 18, 1986

[51] Int. Cl.[4] ..... B02C 1/06

[52] U.S. Cl. ..... 241/266; 241/290

[58] Field of Search ..... 241/264–269, 241/101.2, 285 R, 214, 215, 218, 208, 210, 175, 290, 300

[56] References Cited

U.S. PATENT DOCUMENTS 3,079,096 2/1963 McConnell ..... 241/266 X

*Primary Examiner*—Mark Rosenbaum

*Attorney, Agent, or Firm*—John A. Bucher

[57] ABSTRACT

A jaw crusher has converging and opposed jaws defining a space for passage of material to be crushed. An improved design for supporting the jaws in floating relation on a frame structure of the crusher includes: upper and lower elongated resilient members connected with the frame structure and upper and lower reaction members connected to each jaw for respective interaction with the elongated resilient members, the upper and lower reaction members being substantially diametrically opposed to each other for permitting oscillatory movement of the jaws while at the same time limiting travel of the jaws in all directions on the frame structure. The improved jaw with upper and lower reaction members as described above facilitates drop-in assembly of the jaws in the crusher.

6 Claims, 3 Drawing Sheets

JAW CRUSHER WITH DROP-IN JAWS

FIELD OF THE INVENTION

The present invention relates to rock crushing machines and more particularly to such machines wherein oscillatory vibration or motion is produced in opposed jaws by means of eccentric masses or the like.

BACKGROUND OF THE INVENTION

U.S. Pat. No. 3,079,096, entitled "Crushing Apparatus" issued Feb. 26, 1963 to David P. McConnell, father of one of the inventors herein. The crusher described and claimed in that patent is particularly representative of the prior art with respect to the present invention and is accordingly discussed in greater detail below. The jaw crusher of the present invention includes certain features in common with the apparatus of the above patent and also in common with a copending application, Ser. No. 06/943,552 entitled "Improved Jaw Crusher with Multiple Drive Means" and filed Dec. 18, 1986 by David P. McConnell, one of the inventors herein.

Accordingly, both U.S. Pat. No. 3,079,096 and the copending application referred to above are incorporated herein as though set forth in their entirety in order to provide a more complete understanding of the present invention particularly as to common crushing apparatus features.

The crushing apparatus of the present invention also includes certain features in common with apparatus disclosed in another copending patent application, Ser. No. 06/823,309 filed Jan. 28, 1986 by David P. McConnell, one of the inventors herein, entitled "Jaw Crushing Apparatus" and now assigned to the assignee of the present invention. Accordingly, that copending and commonly owned reference is also incorporated herein as though set forth in its entirety.

Referring now to the incorporated references, U.S. Pat. No. 3,079,096 disclosed a jaw crusher of the type generally referred to above wherein an eccentric mass was supported for rotation behind each of its opposed jaws. Substantial forces acting upon the jaws were absorbed by resilient means including wheels with pneumatic tires arranged in shoes or cylindrical tracks. In addition to absorbing tremendous shock loading on the jaws, the resilient tires permitted the jaws to move away from each other as necessary when uncrushable material formed, for example, from hardened steel or the like, entered between the jaws.

Accordingly, the jaw crusher of the reference was particularly effective in crushing materials such as rock while preventing the jaws or other portions of the crusher from being damaged by uncrushable material passing between the jaws.

Other jaw crushers including opposed vibratory jaws operated by rotating eccentric masses have also been disclosed in the prior art. For example, reference is made to U.S. Pat. No. 1,247,701 issued Nov. 27, 1917 to Michaelsen. However, at least for purposes of the present invention, these other prior art jaw crushers are believed to be generally equivalent to that of the above incorporated reference.

Although the prior art jaw crushers discussed above were very effective for their purpose, it has been found desirable to further improve their design for further enhancing jaw crusher operation in a variety of applications.

In particular, it has been found that assembly and disassembly is relatively difficult for such crushers with opposed jaws. This is most noticeable in connection with the jaws themselves which tend to experience substantial wear during operation of the crusher and must accordingly be replaced or rebuilt relatively frequently.

Accordingly, there has been found to remain a need for a jaw crusher exhibiting improvements in the areas discussed above as well as in other areas.

SUMMARY OF THE INVENTION

It is therefore an object of the present invention to provide an improved jaw crusher capable of overcoming disadvantages such as those discussed above.

It is a further related object of the invention to provide a jaw crusher having an improved design for supporting at least one jaw in floating relation on a frame structure of the crusher while facilitating assembly and disassembly of the crusher, the improved design including upper and lower elongated resilient members connected with the frame structure behind the one jaw, and upper and lower reaction members connected to the one jaw for respective interaction with the upper and lower elongated resilient members, the upper and lower reaction members being formed in substantially diametric relation for encompassing diametrically opposed portions of the upper and lower elongated resilient members in order to permit oscillatory movement of the one jaw in response to the eccentric means while at the same time limiting travel of the one jaw in all directions on the frame structure.

Preferably, the crusher is designed with both jaws being similarly configured and mounted on its frame structure.

It is preferred that the upper elongated resilient member be replaceably connected to the frame structure to facilitate assembly and disassembly of either or both jaws as drop-in units. It is also preferred that the lower elongated resilient member be connected with the frame structure by additional floating mount means for permitting increased movement of the first jaw relative to the frame structure. Such a configuration is described in greater detail within the incorporated copending reference entitled "Jaw Crushing Apparatus". The additional floating mount provided at the bottom of the jaw is particularly important when the overall configuration of the jaw crusher is considered. As described in greater detail below, lower Portions of the jaws converge toward each other and are preferably generally parallel in order to achieve fine crushing of material hefore it exits from the hottom of the crusher. Increased movement made possible by the additional floating mount at the bottom of the jaws allows these portions of the jaws to move even further apart from each other in order to allow uncrushable material to pass through the crusher without damaging or plugging the crusher.

It is yet another related object of the invention to provide an improved crusher jaw of drop-in configuration as described above for use with a crusher. Here again, it is preferably contemplated that two drop-in jaws of similar design be employed in a single crusher.

Additional objects and advantages of the invention are made apparent in the following description having reference to the accompanying drawings.

DESCRIPTION OF THE PREFERRED EMBODIMENT

Figure 1:
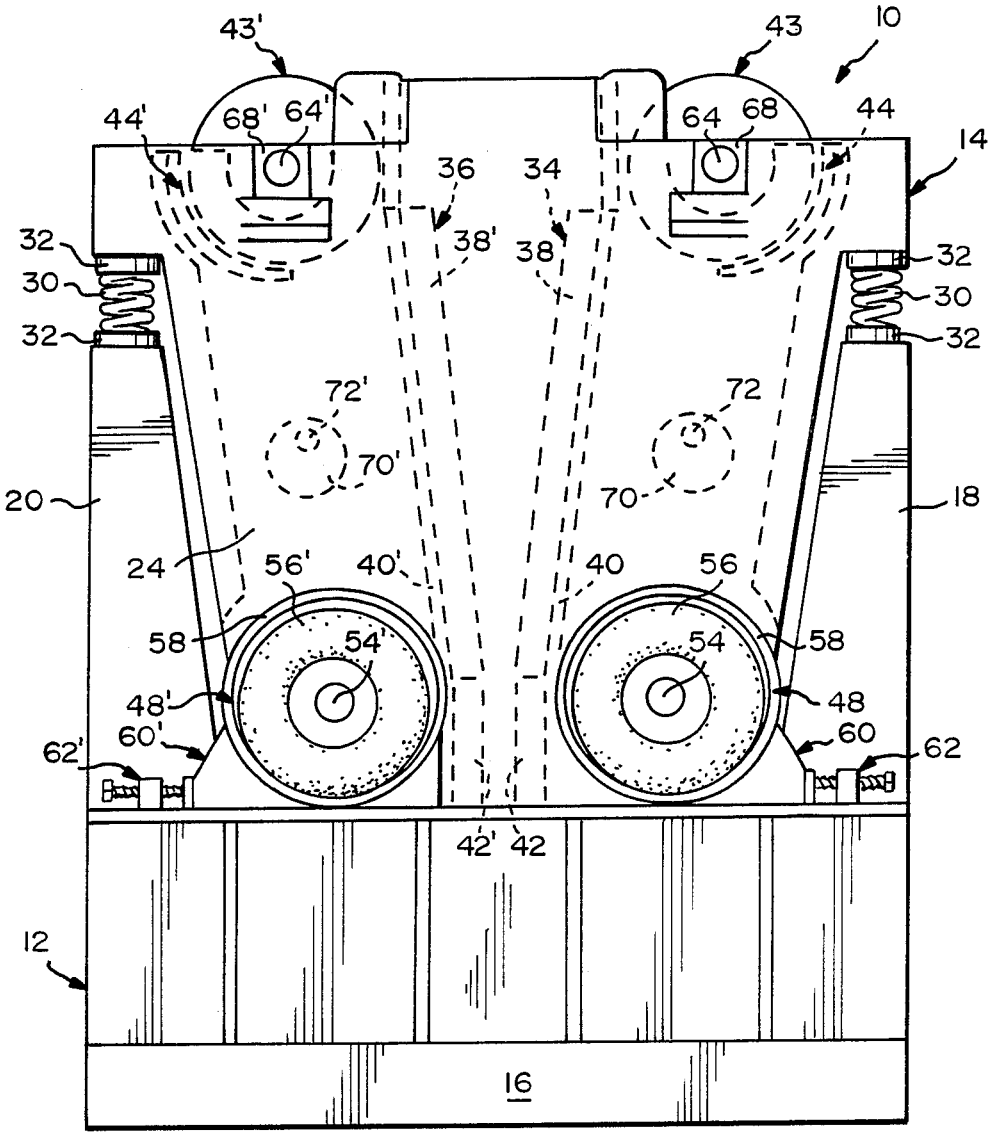
FIG. 1 is a side view of a jaw crusher constructed in accordance with the present invention.

A jaw crusher constructed according to the present invention is generally indicated at 10 in the drawings and includes a base frame assembly 12 and a fabricated floating irame or jaw carriage structure 14. The base frame assembly 12 includes a platform 16 and upright frame members 18 and 20. Both the base frame assembly 12 and jaw carriage frame 14 are substantially reinforced as illustrated.

The jaw carriage frame 14 includes opposed upright side Plates 24 and 26 which are rigidly interconnected by cross members 28. The jaw carriage frame 14 is resiliently supported upon the base frame 12 by a plurality of coiled springs 30 interposed between the upright frame members 18 and 20 of the base frame 12 and the cross members 28 of the jaw carriage frame 14. The springs 30 are positioned relative to both the upright frame members 18 and 20 and the cross members 28 by means of positioning cups 32.

A pair of crusher jaws 34 and 36 are mounted on the jaw carriage frame 14 in a manner described in greater detail below ior allowing oscillatory or vibratory movement of the jaws in synchronized relation with each other. The mounting of the jaws 34 and 36 upon the jaw carriage frame 14 is of particular importance because of the very substantial shock forces acting upon the jaws during operation of the crusher.

In any event, it will be more apparent from the following description that, in their oscillatory or vibratory movement, the jaws experience an upward stroke where they move upwardly and away from each other followed by a downward stroke where the jaws move downwardly and toward each other. The upward and downward strokes of the jaws produce vibratory and oscillatory movement in order to develop crushing force on rocks or other material passing between the jaws.

As noted above, the crusher jaws 34 and 36 are of substantially similar construction except that they are formed as mirror images of each other. Accordingly the following description for the crusher jaw 34 also applies to the crusher jaw 36 with similar primed numerical labels being employed. Although both jaws 34 and 36 are described as being similarly configured and mounted in the crusher, it is again noted that one jaw could be relatively fixed with the other jaw being mounted in the manner described below.

Figure 3:
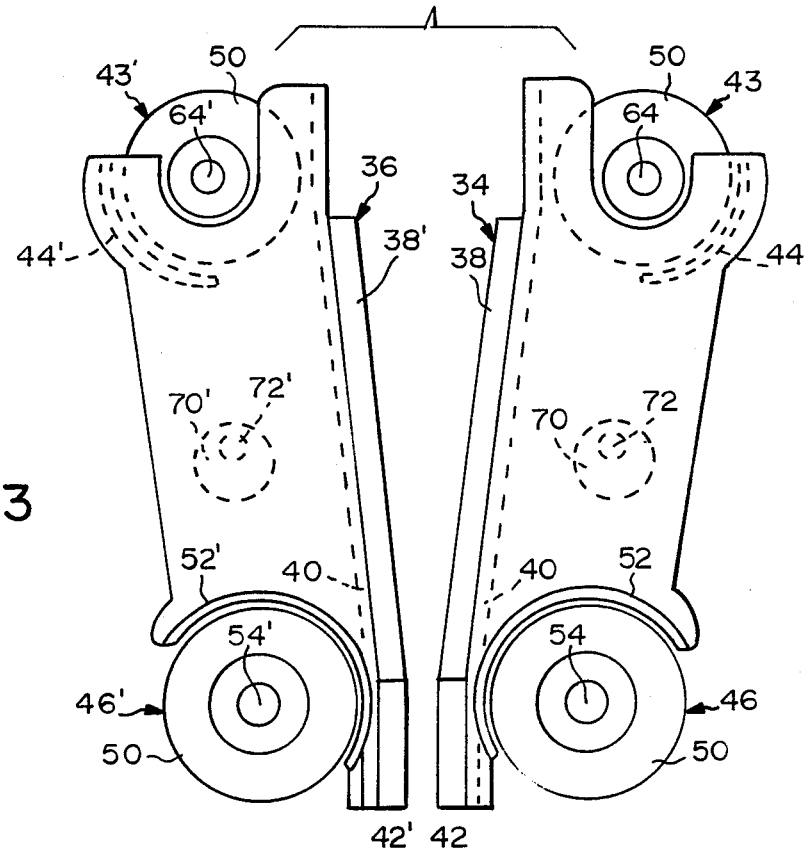
FIG. 3 is a fragmentary side view of the opposed jaws in the crusher to better illustrate their construction and configuration.

Referring now particularly to FIGS. 1 and 3, the crusher jaw 34 is formed with an upper hardened face plate 38 and a lower hardened face plate 42. Both plates 38 and 42 are secured to a backing plate 40 preferably by means of countersunk bolts or studs (not shown) in order to permit their removal or replacement on the jaw.

The angular relationship between the upper and lower face plates 38 and 42 on the crusher jaw 34 and the upper and lower face plates 38' and 42' on the jaw 36 is important for achieving more effective crushing action on rocks or other material passing between the jaws.

Generally, it is desirable for the lower face plates 42 and 42' to be substantially parallel with each other, for example, when fine crushing is desired within the crusher 10. At the same time, the upper face plates 38 and 38' form a wider converging angle for receiving material to be crushed in the crusher 10.

For a further discussion of the jaws 34 and 36 and their preferred configuration, reference is made to the incorporated references noted above.

It is again noted that the present invention is particularly directed toward the manner in which the crusher jaws 34 and 36 are supported for oscillatory vibrating movement in the floating frame structure 14. In addition, the invention is particularly concerned with the configuration of the jaws 34 and 36 themselves in order to permit them to be of a drop-in design for facilitating installation and removal of the jaws from the crusher 10.

Figure 2:
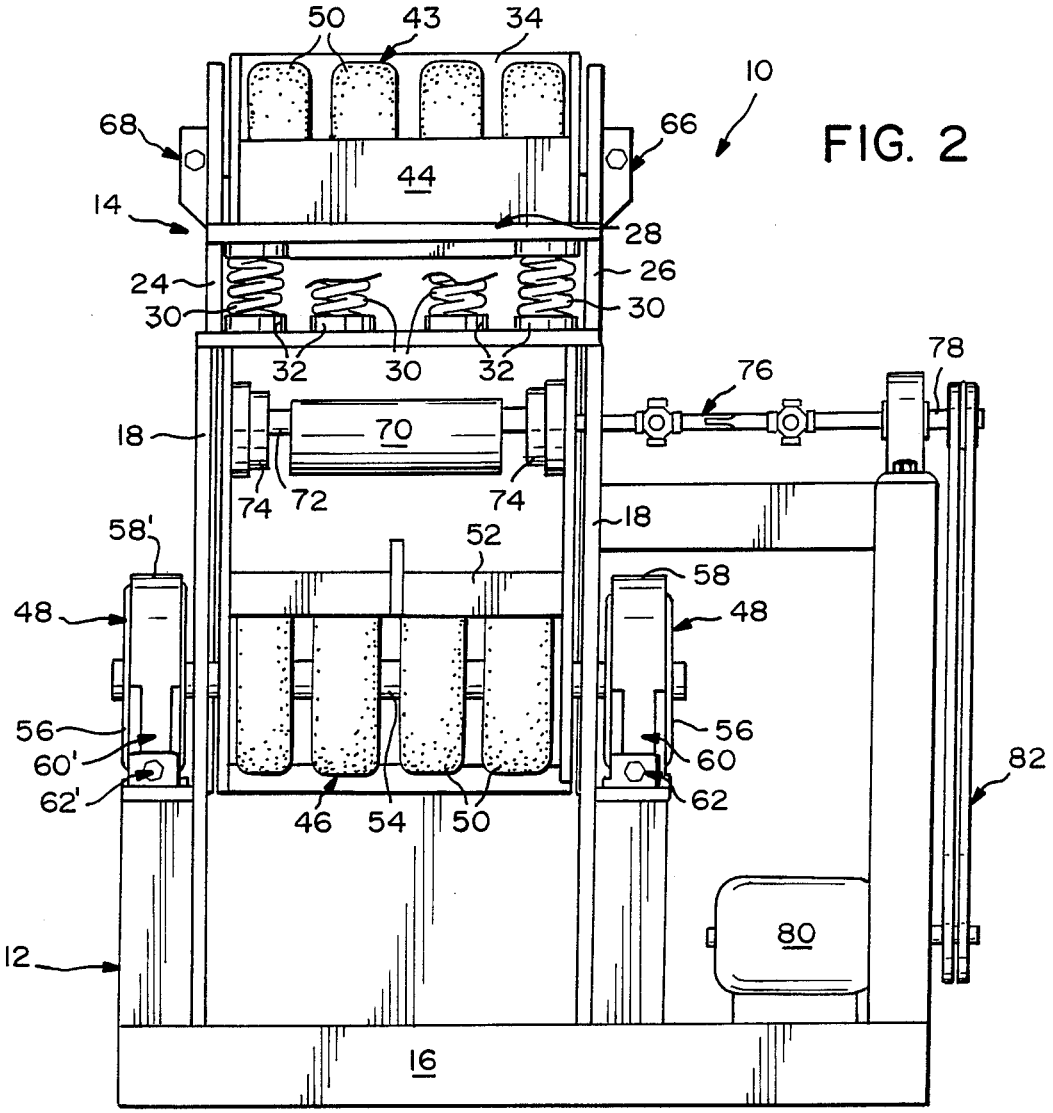
FIG. 2 is a view taken from the left side of FIG. 1 in order to show additional features of the invention.
Figure 4:
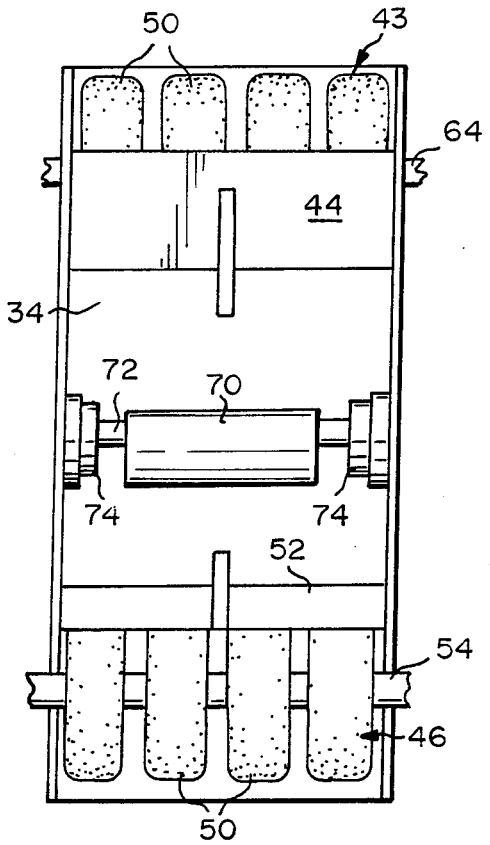
FIG. 4 is a view of one of the jaws taken from the right side of FIG. 3.

Continuing with reference to FIGS. 1, 2 and 3, the upper end of the jaw 34 is supported by an elongated resilient member 43 which is connected to the jaw carriage frame 14 and interacts with an upper reaction member 44 attached to or forming an integral portion of the jaw 34.

The lower portion of the jaw 34 is supported relative to the jaw carriage frame 14 by series connected resilient floating mounts 46 and 48. The floating mount 46 comprises an elongated resilient member similar to the upper member 43. Both the upper elongated resilient member 42 and the floating mount or lower elongated resilient member 46 are formed from compressible and resilient tires 50.

A lower reaction member 52 is attached to or integrally formed on a lower portion of the jaw 34 for interacting with the lower elongated resilient member 46.

The tires or wheels 50 in the lower elongated resilient member 46 are arranged upon a shaft or axle 54 which in turn is supported in resilient, floating relation on the jaw carriage frame 14 by the second resilient floating mount 48.

As illustrated in FIGS. 2 and 3, the second resilient floating mount 48 also comprises compressible and resilient tires 56 mounted on opposite ends of the axle 54 and arranged within additional mounting means in the form of rigid shoes or cylindrical tracks 58. Each of the shoes or tracks 58 is rigidly supported by an adjusting block 60 which is positioned, for example, to adjust spacing between the jaws by means of an adjusting screw assembly 62 secured to the base frame assembly 12.

Thus, the combination of the first and second resilient floating mounts 46 and 48 together with similar mounts 46' and 48' for the other jaw 36 provide a number of advantages within the present invention. Initially, they further extend the effective stroke of the jaws as described above for increasing crushing capacity of the apparatus 10 while also more readily permitting uncrushable material or objects to pass between the jaws and out of the crusher without damaging or plugging the crusher. Other advantages for the series connected floating mounts 46 and 48 are set forth in the incorporated reference entitled "Jaw Crushing Apparatus".

It is again noted that oscillating vibratory travel of each jaw, for example, the jaw 34, is permitted by radial spacing between the pneumatic tires 50 and the lower reaction member 52 together with similar spacing between the tires 56 and the cylindrical track 58 of the second resilient floating mount.

The tires 50 in the upper elongated resilient member 42 are similarly arranged upon a shaft or axle 64 which is adjustably and replaceably connected to the jaw carriage frame 14 by means of a replaceable and adjustable mounting blocks 66 and 68 arranged at each end of the axle 64. The replaceable construction for the upper elongated resilient member 43 is important in connection with the drop-in configuration of the jaw 34 as described in greater detail below.

Referring now particularly to FIG. 3, the drop-in configuration for the jaw 34 is particularly dependent upon the configuration for the upper and lower reaction members 44 and 52. Generally, these members are diametrically arranged with relation to each other so that, in combination, they limit travel of the jaw in all directions in response to operation of eccentric means generally indicated at 70 and described in greater detail below.

With the upper and lower elongated resilient members 43 and 46 being formed from cylindrical tires, for example, the upper and lower reaction members 44 and 52 are also cylindrical but limited in extent to less than 180° in order to facilitate their movement relative to the tires 50.

As may be best seen in FIG. 3, the lower reaction member 52 is approximately 180° in extent while being arranged generally above the lower elongated resilient member 46. At the same time, the upper reaction member 44 is arranged generally beneath the upper elongated resilient member 43. Thus, the lower reaction member 52 tends to support the jaw 34 on the jaw carriage frame 14 and to prevent downward travel of the jaw. At the same time, the upper reaction member 44 tends to prevent or limit excessive upward travel of the jaw 34, for example, in response to operation of the eccentric means 68.

Furthermore, because of the arrangement of the reaction members 44 and 52, with the upper elongated resilient member 42 being removed from the jaw carriage frame 14 as described above, the entire jaw 34 can simply be raised upwardly as viewed in FIG. 3 or lowered downwardly ior installation in the crusher. At the same time, the upper reaction member 44 also serves a restraining function in preventing the upper end of the jaw 34 from collapsing inwardly toward the jaw 36, particularly when the crusher is empty.

Referring particularly to FIG. 1, the eccentric means 68 is illustrated as an elongated eccentric mass arranged upon a shaft 72 supported at its opposite ends by bearings 74 on the jaw carriage frame 14. The elongated configuration of the eccentric mass 68 permits it to be of reduced diameter so that it can be mounted more closely adjacent the jaw 34 as may also be seen in FIGS. 2 and 3.

The shaft 72 is connected by means of a universal drive assembly 76 with a drive shaft 78 which is interconnected with a drive motor 80 by drive belts generally indicated at 82. The universal drive assembly 76 permits the shaft 72 to be disconnected from the drive shaft 78 so that the eccentric means 68 can be assembled and disassembled from the crusher 10 as part of the drop-in jaw assembly 34.

Once again, it is noted that the other jaw 36 is of substantially similar construction and mounting as the jaw 34.

Accordingly, there has been described a novel jaw crusher 10 wherein the jaws 34 and 36 are of drop-in configuration for facilitating installation and removal or replacement of the jaws in the crusher. As noted above, this is particularly important since wear is primarily experienced within the jaws themselves.

Various modifications and additions are believed apparent in addition to those specifically discussed above. Accordingly, the scope of the present invention is defined only by the following appended claims.

What is claimed is:

1. In a jaw crusher including a supporting frame structure, first and second opposed downwardly converging crusher jaws defining therebetween space for passage of material to be crushed, means supporting the second jaw on the frame structure for opposed crushing action relative to the first jaw, and eccentric means for imparting oscillatory vibration to at least one of the first and second jaws for producing crushing action, an improved design for supporting the first jaw in floating relation on the frame structure and for facilitating assembly or disassembly of the crusher, comprising upper and lower elongated resilient members connected with the frame structure and arranged opposite a face of the first jaw, and upper and lower reaction members connected to the first jaw for respective interaction with the upper and lower elongated resilient members, the upper and lower reaction members encompassing diametrically related portions of the upper and lower elongated resilient members relative to their respective axes for permitting oscillatory movement of the first jaw in response to the eccentric means while at the same time limiting travel of the jaw in all directions on the frame structure, the upper and lower elongated resilient members being cylindrical, the upper and lower reaction members also being cylindrical in configuration and no more than about 180° in extent to facilitate their movement relative to the upper and lower elongated resilient members.

2. The improved jaw crusher of claim 1 wherein the upper reaction member is arranged generally below the upper elongated resilient member and the lower reaction member is arranged generally above the lower elongated resilient member, the upper elongated resilient member being replaceably connected to the frame structure to facilitate assembly and disassembly of the first jaw from the crusher.

3. The improved jaw crusher of claim 2 wherein the lower elongated resilient member is connected with the frame structure by additional floating mount means for permitting increased movement of the first jaw relative to the frame structure.

4. The improved jaw crusher of claim 3 wherein the upper and lower elongated resilient members are formed from compressible tires.

5. The improved jaw crusher of claim 4 wherein the second jaw is similarly supported in floating relation on the frame structure by upper and lower elongated resilient member and upper and lower reaction members as the first jaw.

6. The improved jaw crusher of claim 2 wherein the second jaw is similarly supported in floating relation on the frame structure by upper and lower elongated resilient members and upper and lower reaction members as the first jaw.

* * * * *